US006419597B1

(12) United States Patent
van Nimwegen et al.

(10) Patent No.: US 6,419,597 B1
(45) **Date of Patent: *Jul. 16, 2002**

(54) ELECTROMECHANICAL COMPRESSION CRANK ADJUSTMENT MECHANISM FOR A BASKETBALL GOAL ASSEMBLY

(75) Inventors: Edward G. van Nimwegen, North Ogden; David C. Winter, Layton, both of UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/694,620

(22) Filed: Oct. 23, 2000

Related U.S. Application Data

(63) Continuation-in-part of application No. 09/249,278, filed on Feb. 11, 1999, now Pat. No. 6,135,901, which is a continuation-in-part of application No. 09/018,231, filed on Feb. 3, 1998, now Pat. No. 6,077,177, which is a continuation-in-part of application No. 08/986,382, filed on Dec. 8, 1997, now Pat. No. 5,879,247, which is a continuation of application No. 08/799,979, filed on Feb. 12, 1997, now Pat. No. 5,695,417.

(51) Int. Cl.[7] ..... A63B 63/08

(52) U.S. Cl. ..... 473/484; 473/483; 473/482; 473/481; 248/283.1; 248/280.11

(58) Field of Search ..... 473/471, 481–484; 248/283.1, 404, 280.11, 161, 162.1

(56) References Cited

U.S. PATENT DOCUMENTS

| | | | |
|---|---|---|---|
| 276,637 | A | 5/1883 | Slater |
| 1,924,811 | A | 8/1933 | Schulz |
| 2,932,511 | A | 4/1960 | Bemis |
| 3,427,025 | A | 2/1969 | Procter |
| 3,586,324 | A | 6/1971 | Bearson |

(List continued on next page.)

FOREIGN PATENT DOCUMENTS

| | | |
|---|---|---|
| NL | 28616 | 2/1965 |

OTHER PUBLICATIONS

Harvard, "1988 Sporting Goods Catalog," p. 8.

Diversified Products, "DP Fit for Life," 1990 Equipment Catalog, Opelika, Alabama, p. 61.

Bison, "An American Legacy", Bison Recreational Products 1993–94 Catalog.

(List continued on next page.)

*Primary Examiner*—Raleigh W. Chiu
(74) *Attorney, Agent, or Firm*—Workman, Nydegger & Seeley

(57) ABSTRACT

The invention relates to a compression crank adjustment mechanism for a basketball goal assembly that allows for adjustment of the height of a basketball goal into a plurality of configurations above a playing surface. The basketball goal assembly includes a deformable goal support structure having a first end pivotally attached to a rigid support pole. A basketball goal is preferably attached at a second opposing end of the goal support structure. An extension arm may be connected between the goal support structure and a first adjustment member preferably positioned along the back side of the support pole. A second adjustment member may be connected to the support pole and configured for threaded engagement with the first adjustment member. Preferably, the first and second adjustment members are operably disposed in compression relative to each other under the forces acting on the basketball goal assembly. An electromechanical driver operably engages an end of the first adjustment member and is configured to selectively rotate the first adjustment member relative to the second adjustment member to facilitate movement of the first adjustment member relative to the second adjustment member and thereby selectively dispose the goal support structure into any one of the plurality of configurations of height in relation to said playing surface.

22 Claims, 6 Drawing Sheets

U.S. PATENT DOCUMENTS

| | | | | | |
|---|---|---|---|---|---|
| 3,765,676 | A | | 10/1973 | Bearson et al. | |
| 3,802,702 | A | | 4/1974 | Pulley | |
| 4,395,040 | A | | 7/1983 | White | |
| 4,438,923 | A | | 3/1984 | Engle et al. | |
| 4,441,709 | A | | 4/1984 | Schroeder et al. | |
| 4,465,277 | A | | 8/1984 | Dittrich | |
| 4,684,129 | A | | 8/1987 | Andersen et al. | |
| 4,781,375 | A | | 11/1988 | Nye | |
| 4,798,381 | A | | 1/1989 | Dadbeh | |
| 4,801,142 | A | | 1/1989 | Friesen | |
| 4,805,904 | A | | 2/1989 | Nye | |
| 4,846,469 | A | | 7/1989 | Nye | |
| 4,881,734 | A | | 11/1989 | Nye | |
| 4,951,944 | A | * | 8/1990 | Morgan | 473/483 |
| 5,133,547 | A | | 7/1992 | Pardi | |
| 5,158,281 | A | | 10/1992 | Williams | |
| 5,211,393 | A | | 5/1993 | Rolffs et al. | |
| 5,259,612 | A | | 11/1993 | Matherne et al. | |
| D350,797 | S | | 9/1994 | Curtis | |
| 5,388,821 | A | | 2/1995 | Blackburn | |
| 5,465,957 | A | | 11/1995 | Schroeder | |
| 5,478,068 | A | | 12/1995 | Schroeder | |
| 5,503,390 | A | | 4/1996 | Hall | |
| 5,573,237 | A | | 11/1996 | Van Nimwegen et al. | |
| 5,573,238 | A | | 11/1996 | Aaron et al. | |
| 5,601,284 | A | | 2/1997 | Blackwell et al. | |
| 5,695,417 | A | | 12/1997 | Winter et al. | |
| 5,720,679 | A | | 2/1998 | Schroeder | |
| 5,738,601 | A | | 4/1998 | Hughes | |
| 5,800,295 | A | * | 9/1998 | Rogitz | 473/483 |
| 5,879,247 | A | | 3/1999 | Winter et al. | |
| 6,077,177 | A | | 6/2000 | Winter et al. | |
| 6,135,901 | A | | 10/2000 | van Nimwegen | |

OTHER PUBLICATIONS

"Component Play Grounds," Equipment Brochure, Salt Lake City, Utah, p. 6 (date unknown).

BPI, "BPI Portable Systems", Basketball Products International Catalog (date unknown).

BPI, "At the Heart of the Sport", Basketball Products International Catalog (date unknown).

Diversified Products, "25 Years of Innovation," Opelika, Alabama, p. 69 (date unknown).

Escalade Sports, "Serious Play", 1997 Products Catalog featuring Harvard, Stiga, and Spalding Products.

Goalrilla Basketball Systems, "A–LIN Series", Product Brochure (date unknown).

HHBS, Inc., "Pro Series", Basketball Systems Brochure (date unknown).

Huffy Sports, "Be A Player", Client assembled folder of fact sheets (date unknown).

Huffy Sports, "Introducing New Huffy Elevator," Informational Brochure, Waukesha, Wisconsin (date unknown).

Huff Sports, "Basketball's Hottest Products this Year," Equipment Catalog, Waukesha, Wisconsin (date unknown).

Huffy Sports, Equipment Catalog, Waukesha, Wisconsin, p. 21 (date unknown).

Huffy Sports, "Our All–Star Lineup," Waukesha, Wisconsin, p. 21 (date unknown).

Huffy Sports, Equipment Assembly Instruction Sheet, Waukesha, Wisconsin (date unknown).

Porter, "All–in–One "Quick Adjust" Kits," Informational Brochure (date unknown).

Rolbak, "The Original Basket Ball Protecto Net" Fact Sheet (date unknown).

Spalding, "Movers Don't Have to be Shakers", Pro System Mobile Brochure (date unknown).

Sport Court, "Slam Systems", Basketball Standards Catalog (date unknown).

Sure Shot, "Your Best Shot", Product Catalog (date unknown).

Ultra Rim Adjustable Basketball Goals, "The Ultimate Goal", Two–Fold Brochure (date unknown).

Wilson, "Adjustable Backstop Support, Backboard and Goal Kit," Informational Brochure, Franklin Park, IIIinois (date unknown).

* cited by examiner

ELECTROMECHANICAL COMPRESSION CRANK ADJUSTMENT MECHANISM FOR A BASKETBALL GOAL ASSEMBLY

RELATED U.S. APPLICATIONS

This application is a continuation-in-part of our co-pending patent application Ser. No. 09/249,278, filed Feb. 11, 1999, and entitled COMPRESSION CRANK ADJUSTMENT MECHANISM FOR A BASKETBALL GOAL ASSEMBLY, now U.S. Pat. No. 6,135,901, which is a continuation-in-part of application Ser. No. 09/018,231, filed Feb. 3, 1998, and entitled ADJUSTABLE BASKETBALL GOAL SYSTEM, now issued as U.S. Pat. No. 6,077,177, which is a continuation-in-part of application Ser. No. 08/986,382 filed, Dec. 8, 1997, and entitled POWER LIFT BASKETBALL ADJUSTMENT SYSTEM, now issued as U.S. Pat. No. 5,879,247, which is a continuation of application Ser. No. 08/799,979, filed Feb. 12, 1997, and entitled POWER LIFT BASKETBALL ADJUSTMENT SYSTEM, now issued as U.S. Pat. No. 5,695,417. The foregoing applications are incorporated herein by reference.

BACKGROUND

1. The Field of the Invention

The present invention is related to an apparatus for adjusting the height of a basketball goal above a playing surface and, more particularly, to a novel electromechanical compression crank adjustment mechanism for a basketball goal assembly having an extension arm adjustable among a plurality of positions to facilitate the adjustment of the basketball goal over a playing surface.

2. Technical Background

Basketball is an increasingly popular sport in the United States and abroad. There are many cities, counties and other associations that sponsor recreational and instruction leagues where people of all ages can participate in the sport of basketball. Today there are organized leagues for children as young as five and six years old. Accordingly, it is not surprising that more and more people have a basketball goal assembly mounted on their own property.

The problem with many basketball goal assemblies of the prior art is that the goal is usually fixed at a certain height above the playing surface, with a standard height being about ten (10) feet. Children and younger teens, however, generally do not have the strength or agility to shoot and make a basket at the typical height of ten feet. Moreover, children tend to develop improper shooting skills by attempting to throw a basketball toward a goal that is disposed too high. Oftentimes, children or younger teens get frustrated with the sport of basketball and may give up the sport altogether.

Many attempts have been made by those skilled in the art to design basketball goal assemblies which are adjustable to several different heights. Adjustable basketball goal assemblies allow persons of all ages and sizes to enjoy the sport of basketball because the basketball goal can be adjusted to various heights above the playing surface. Some prior art basketball goal assemblies employ a deformable linkage design which generally connects the backboard to a rigid mount such as a support pole. In operation, prior art deformable linkages may be selectively locked at various positions to secure the basketball goal at a predetermined height above the playing surface.

One disadvantage of prior art deformable linkage devices is that the adjustment mechanism is typically positioned within or near the linkage which is generally well above the playing surface. Accordingly, whenever a user desires to adjust the height of the basketball goal, the use of a ladder, stool or the like is required to enable the user to reach the adjustment mechanism and "unlock" the basketball goal. Having to use a ladder, stool or the like to adjust the height of the basketball goal creates an inherent danger to the user of the potential for falling.

Other prior art adjustable basketball goal assemblies were developed having an adjustment mechanism that is only accessible with the use of a separate rod or pole, such as a broomstick handle. Often times, there is not such an adjustment device readily available. The user must therefore accommodate the inconvenience of having to find a suitable implement, or simply choose not to adjust the height of the basketball goal.

Another disadvantage of many prior art adjustable basketball goal assemblies is that the mechanism for adjusting the height of the basketball goal is separate and distinct from the mechanism used to secure the goal assembly at a particular height. Thus, both hands of a user are normally needed to simultaneously unlock the adjustment mechanism, adjust the basketball goal and then lock the adjustment mechanism at a predetermined position relative to the playing surface.

Some prior art basketball goal assemblies are configured with the adjustment mechanism positioned adjacent the basketball playing area. Such adjustment mechanisms can interfere with the game play of one or more users, thereby creating a potentially dangerous situation. For example, such adjustable basketball goal assemblies are usually subject to inadvertent adjustment if bumped by a user or accidentally hit with a basketball.

Yet another disadvantage of prior art basketball goal assemblies is that the adjustment mechanism is in tension with the linkage device attached to the goal, thus the locking or adjustment mechanism is susceptible to separation upon failure and, accordingly, the goal assembly may drop into the playing area and cause potential injuries to users. Another disadvantage of prior art basketball goal adjustment assemblies is that many of the securing and adjustment mechanisms require numerous working components and a complex design configuration to be able to simultaneously adjust and secure the basketball goal assembly in a predetermined position above a playing surface. This increases the cost, the difficulty of manufacture and the time necessary to assemble the basketball goal assembly by a user.

From the foregoing, it will be appreciated that it would be an advancement in the art to provide an adjustable basketball goal assembly that can be adjusted without the use of a ladder or a pole. It would be a further advancement to provide such an adjustable basketball goal assembly that may be quickly and easily adjusted using a single hand of a user. It would be yet another advancement in the art to provide an adjustable basketball goal assembly that does not interfere with game play and that would not endanger users if the adjustment or locking mechanism failed. It would be a further advancement in the art to provide an adjustment assembly that incorporates an electromechanical mechanism to assist in selectively adjusting the height of a basketball goal above a playing surface. Finally, it would be an advancement in the art to provide an adjustable basketball goal assembly that is simple in operational design and cost effective relative to manufacture.

Such an adjustable basketball goal assembly is disclosed and claimed herein.

BRIEF SUMMARY OF THE INVENTION

The present invention is directed to a novel adjustable basketball goal assembly having a compression crank mechanism that facilitates adjusting the height of a basketball goal above a playing surface. The basketball goal assembly of the present invention includes a rigid support that extends in a substantially upward direction. The rigid support has a goal side and a back side formed opposite the goal side. A deformable goal support structure may be pivotally attached to the goal side of the rigid support such that the goal support structure is suspended above the playing surface. The goal support structure includes an upper support arm and a lower support arm. In one presently preferred embodiment of the present invention, one of the support arms has a tail section which extends substantially outward from the back side of the rigid support pole.

A basketball goal is preferably attached to the goal support structure adjacent the goal side of the rigid support. In one presently preferred embodiment, the goal consists of a rim, a backboard and a net. The goal support structure is preferably configured such that as the goal support structure deforms, the height of the basketball goal above the playing surface is correspondingly adjusted, wherein each variation in height of the basketball goal corresponds to a different deformation of the goal support structure. In operation, the goal support structure allows the rim of the basketball goal to be adjusted to several different heights while retaining the rim in a substantially horizontal disposition in relation to the playing surface.

In one presently preferred embodiment, an adjustment crank is pivotally mounted at the back side of the rigid support pole such that a user can adjust the crank without needing a ladder, stool, pole or the like. An extension arm is preferably positioned between the parallelogrammic deformable goal support structure and the adjustment crank substantially along the back side of the rigid support. A first end of the extension arm is pivotally attached to the tail section of the lower support arm and a second opposing end of the extension arm is pivotally attached to the adjustment crank. The extension arm may include a stabilizing arm having a first end pivotally attached to the support pole and a second end pivotally attached contiguous a second end of the extension arm. In this configuration, an adjustment of the crank mechanism moves the extension arm and deforms the parallelogrammic structure, thereby adjusting the height of the basketball goal in relation to the playing surface. Thus, the height of the basketball goal can be adjusted without the use of a ladder or other adjustment implement.

In preferred design, the adjustment crank includes a first adjustment member connected to the extension arm at a first point of attachment and a second adjustment member connected to the rigid support at a second point of attachment disposed above the first point of attachment. Thus, the adjustment crank is in compression under the force of the basketball goal assembly. In one presently preferred embodiment, the first and second adjustment members may be threaded for cooperative engagement with each other. In this regard, the threads are generally configured to provide maximum mechanical advantage and thereby facilitate easy adjustment of the basketball goal assembly.

In one presently preferred embodiment, a crank handle is attached to the first adjustment member to facilitate the selective movement of the first adjustment member relative to the second adjustment member. This configuration permits selective movement of the first adjustment member relative to said second adjustment member which, in turn, deforms the goal support structure and repositions the height of the basketball goal above the playing surface.

In yet another presently preferred embodiment, an electromechanical driver may be connected to the first adjustment member to facilitate the selective movement of the first adjustment member relative to the second adjustment member. An electromechanical driver operably engaging the adjustment crank mechanism facilitates a controlled, systematic movement of the first adjustment member relative to the second adjustment member to facilitate deformation of the goal support structure and thereby permit adjustment to the height of the basketball goal above a playing surface. Similarly, the use of an electromechanical driver associated with the adjustment crank mechanism permits rapid and convenient repositioning in the height of the basketball goal above the playing surface.

The basketball goal assembly may also include a support base configured having an internal cavity sufficient for receiving and retaining a ballast material. Preferably, the support base is configured such that when filled with a ballast material (e.g., water, sand or the like), the weight of the support base is sufficient to stabilize the adjustable basketball goal assembly and support the support pole, disposed in a receiving aperture formed in the support base, in a substantially upright position.

Thus, it is an advantage of the present invention to provide an adjustable basketball goal assembly with an adjustment mechanism in compression with the extension arm and which does not interfere with the playing area. It is another advantage of the present invention to be able to adjust the height of the basketball goal without the aid of a ladder or pole. It is a further advantage of the present invention to be able to easily adjust the height of the basketball goal using only a single hand of a user. It is another advantage of the present invention to provide a compression crank adjustment mechanism for an adjustable basketball goal assembly that is cost effective to manufacture and easy to assemble. Additionally, it is an advantage of the present invention to provide an electromechanical driver operably engaging a compression crank adjustment mechanism to facilitate rapid and convenient repositioning of the height of the basketball goal above a playing surface.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the assembly and method of the present invention, as represented in FIGS. 1 through 6, is not intended to limit the scope of the invention, as claimed, but it is merely representative of the presently preferred embodiments of the invention.

The presently preferred embodiments of the invention will be best understood by reference to the drawings, wherein like parts are designated by like numerals throughout.

Figure 1:
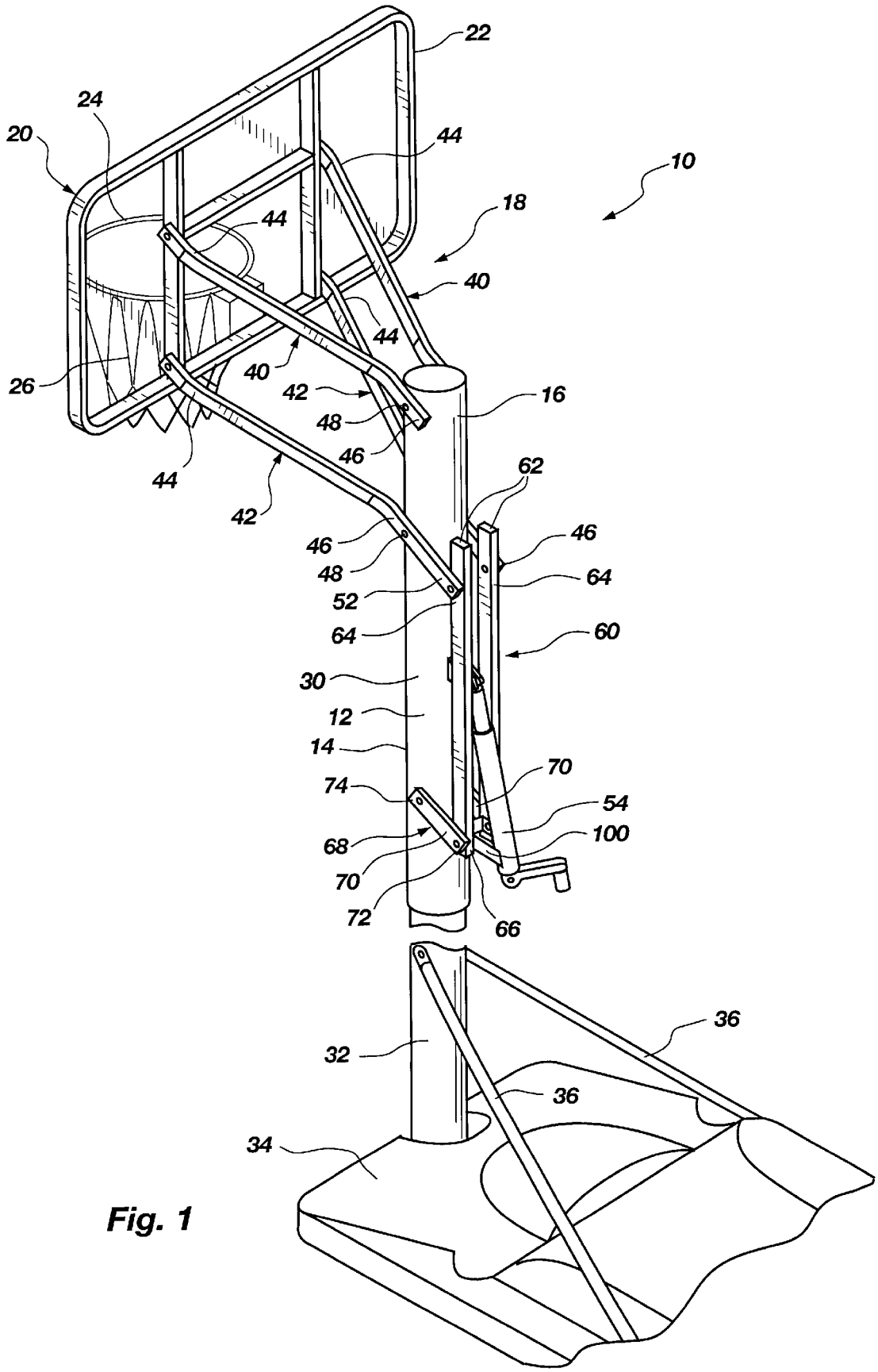
FIG. 1 is a perspective view of one presently preferred embodiment of a compression crank adjustment mechanism for a basketball goal assembly of the present invention.

With reference now to FIG. 1, one presently preferred embodiment of the compression crank adjustment mechanism of the basketball goal assembly according to the present invention is generally designated at 10. As shown, the basketball goal assembly 10 includes a rigid support pole 12 having a goal side 14 and a back side 16 disposed opposite the goal side. The support pole 12 generally extends in a substantially upward direction when the basketball goal assembly 10 is disposed in the playing position.

A goal support structure 18 is disposed in relation to the rigid support pole 12 adjacent a goal side 14 of the rigid support 12 above the playing surface. A basketball goal 20 including a back board 22, a rim 24 and a net 26 may be attached to the goal support structure 18 opposite the support pole 12. The goal support structure 18 may be deformable into a plurality of configurations wherein at each configuration the basketball goal 20 is disposed at a different height above the playing surface.

In one presently preferred embodiment, the support pole 12 includes an upper pole section 30, to which the goal support structure 18 is attached, and a lower pole section 32 introduceable (e.g., press fit) into the upper pole section 30. This configuration makes the adjustable basketball goal assembly 10 easier and more cost effective to package.

As shown, the lower pole section 32 may be attached to a portable support base 34 having an internal cavity for introducing and selectively retaining a ballast material. Functionally, the support base 34 supports and stabilizes the support pole 12 and the goal support structure 18 in relation to the playing surface. A pair of rods 36 may be provided to secure the rigid support 12 to the support base 34. As will be appreciated by those of skill in the art, there are a variety of ways readily known in the art to configure a support base 34 in such a manner to stabilize and secure a rigid support pole 12 in a generally upright position. It will further be appreciated that the teachings of this invention may be practiced using a permanent mount in place of the support base 34 and thereby secure the rigid support 12 directly to the floor or ground at a specific location.

The goal support structure 18 of the adjustable basketball goal assembly 10 may comprise a pair of upper support arms 40 and lower support arms 42. The upper and lower support arms 40, 42 each have a first end 44 and a second end 46, respectively. In one presently preferred embodiment, the first ends 44 of the upper and lower support arms 40, 42 are pivotally attached to the basketball goal 20 at differing locations. Preferably, the upper and lower support arms 40, 42 are each pivotally attached to the rigid support 12 adjacent the second ends 46 of the upper and lower support arms 40, 42 with a fastener 48 (e.g., bolts, screws, rivets or the like) introduced through corresponding openings (not shown) formed within the upper and lower support arms 40, 42 and the rigid support pole 12. The upper and lower support arms 40, 42 are likewise pivotally attached to the basketball goal support 20 by fasteners 48 (e.g., bolts, screws, rivets or the like) positioned through aligned openings (not shown). As will be appreciated, there are a variety of other suitable fixation members or methods readily known in the art to pivotally attach the basketball goal to the rigid support pole 12.

As best shown in FIG. 1, the upper supports 40, the lower supports 42, the support pole 12, and the backboard 22 define a goal support structure 18, which is preferably parallelogrammic in configuration. Because the upper supports 40 and the lower supports 42 are pivotally mounted, the parallelogrammic goal support structure 18 can be deformed to adjust the height of the basketball goal 18 above a playing surface while allowing the backboard 22 to remain substantially vertical in disposition and the rim 24 to remain substantially horizontal in relative disposition.

At least one of the support arms 40, 42 includes a tail section 52 adjacent the second end 46 of the support arms 40, 42 which extends substantially outwardly from the back side 16 of the rigid support 12. In one presently preferred embodiment, the tail section 52 is an integral part of the lower support arms 42. Structurally, the tail section 52 provides a place to link the goal support structure 18 to an adjustment mechanism 54 which is preferably pivotally mounted adjacent the back side 16 of the rigid support 12 such that a user can manipulate the adjustment mechanism 54 while standing on the ground.

Consistent with the foregoing structural configuration, the height of the basketball goal 20 may be adjusted without the aid of a separate adjustment device, ladder, stool or the like. Further, with the adjustment mechanism 54 located on the back side 16 of the rigid support 12, the adjustment mechanism 54 is less likely to interfere with basketball play. In one presently preferred embodiment, the adjustment mechanism 56 comprises an adjustment crank 56.

Figure 2:
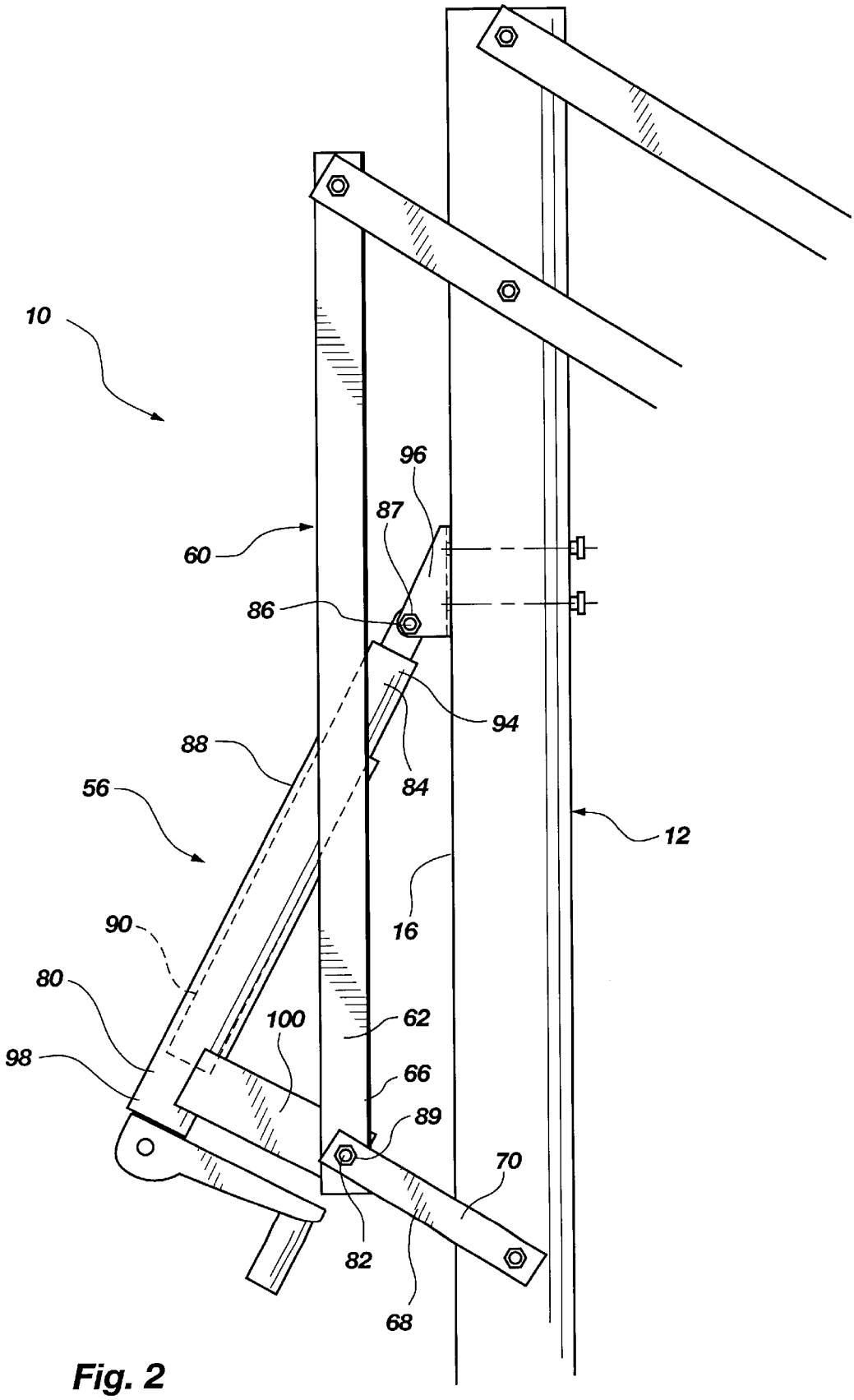
FIG. 2 is a side plan view of the compression crank adjustment mechanism of the basketball goal assembly of FIG. 1.

Referring now to FIGS. 1 and 2, an extension arm 60 includes at least one bar 62. In one presently preferred embodiment, the extension arm 60 includes a pair of bars 62, each having a first end 64 and a second end 66. The first end 64 of each of the bars 62 may be pivotally attached to the respective tail sections 52 of the lower support arms 42. The second end 66 of each of the bars 62 may be disposed for cooperation with the adjustment crank 56, discussed in more detail herein below. The extension arm 60 may include a stabilizer arm 68 that is pivotally attached to the support pole 12. In one presently preferred embodiment, the stabilizer arm 68 includes a pair of tie bars 70 pivotally connected at a first end 72 to the bars 62 and at a second end 74 to the rigid support 12. The extension arm 60 is positioned substantially along the back side 16 of the rigid support 12 such that movement of the extension arm 60 selectively deforms the goal support structure 20. The extension arm 60 may be pivotally attached to the tail section 52 and support pole 12 by a variety of ways known in the art, including bolts, screws, rivets, cotter pins or the like.

As best shown in FIG. 2, the adjustment crank 56 includes a first adjustment member 80 pivotally connected to the extension arm 60 at a first point of attachment 82. The adjustment crank also includes a second adjustment member 84 pivotally connected to the support pole 12 at a second point of attachment 86. A first end 88 of the first adjustment member 80 is configured to cooperate with a first end 90 of the second adjustment member 84 to thereby permit selective movement of the first adjustment member 80 relative to the second adjustment member 84.

In one presently preferred embodiment, the adjustment crank 56 is positioned relative to the rigid support 12 and extension arm 60 such that the second point of attachment 86 is disposed above the first point of attachment 82. One of skill in the art will appreciate that in this configuration, the force due to gravity acting on the basketball goal 20 and transferred to the extension arm 60 will cause the first adjustment member 80 and the second adjustment member 84 to be in compression relative to each other. With the first adjustment member 80 and the second adjustment member 84 in compressive engagement relative to each other, failure of the adjustment mechanism 54 will not result in the first adjustment member 80 and the second adjustment member 84 becoming disengaged from each other, which may result in the basketball goal 20 pivoting downward into the playing area. Accordingly, the compressive engagement of the first adjustment member 80 and the second adjustment member 84 along the back side 16 of the support pole 12 provides a measure of security to the adjustable basketball goal assembly 10.

In one presently preferred embodiment, the second adjustment member 84 is attached at a second end 94 to the support pole 12 by means of a fastener 87 (e.g., bolt, screw, rivet or the like) secured to the back side 16 of the support pole 12. For example, a bolt 87 may be positioned within aligned openings within the second end 94 of the second adjustment member 84 and within a bracket 96 to secure the second adjustment member 84 to the rigid support 12.

The first adjustment member 80 preferably includes a U-shaped bracket 100 welded to a second end 98 of the first adjustment member 80. The U-shaped bracket 100 is configured with a pair of holes (not shown) such that a fastener 89 (e.g., bolt, screw, rivet or the like) may be positioned through the U-shaped bracket 100 and corresponding holes (not shown) through the second end 66 of each bar 62. In one presently preferred embodiment, the fastener 89 is also positioned within holes (not shown) in the first ends 72 of the tie bars 70, such that the adjustment crank 56, extension arm 60 and stabilizer arm 68 are all connected at the first point of attachment 82. It will be readily appreciated by those skilled in the art that the adjustment mechanism 54 may be positioned in a variety of ways relative to the extension arm 60 and the support pole 12 to allow the adjustment mechanism 54 to remain in compression, rather than in tension along the back side 16 of the support pole 12.

Figure 3:
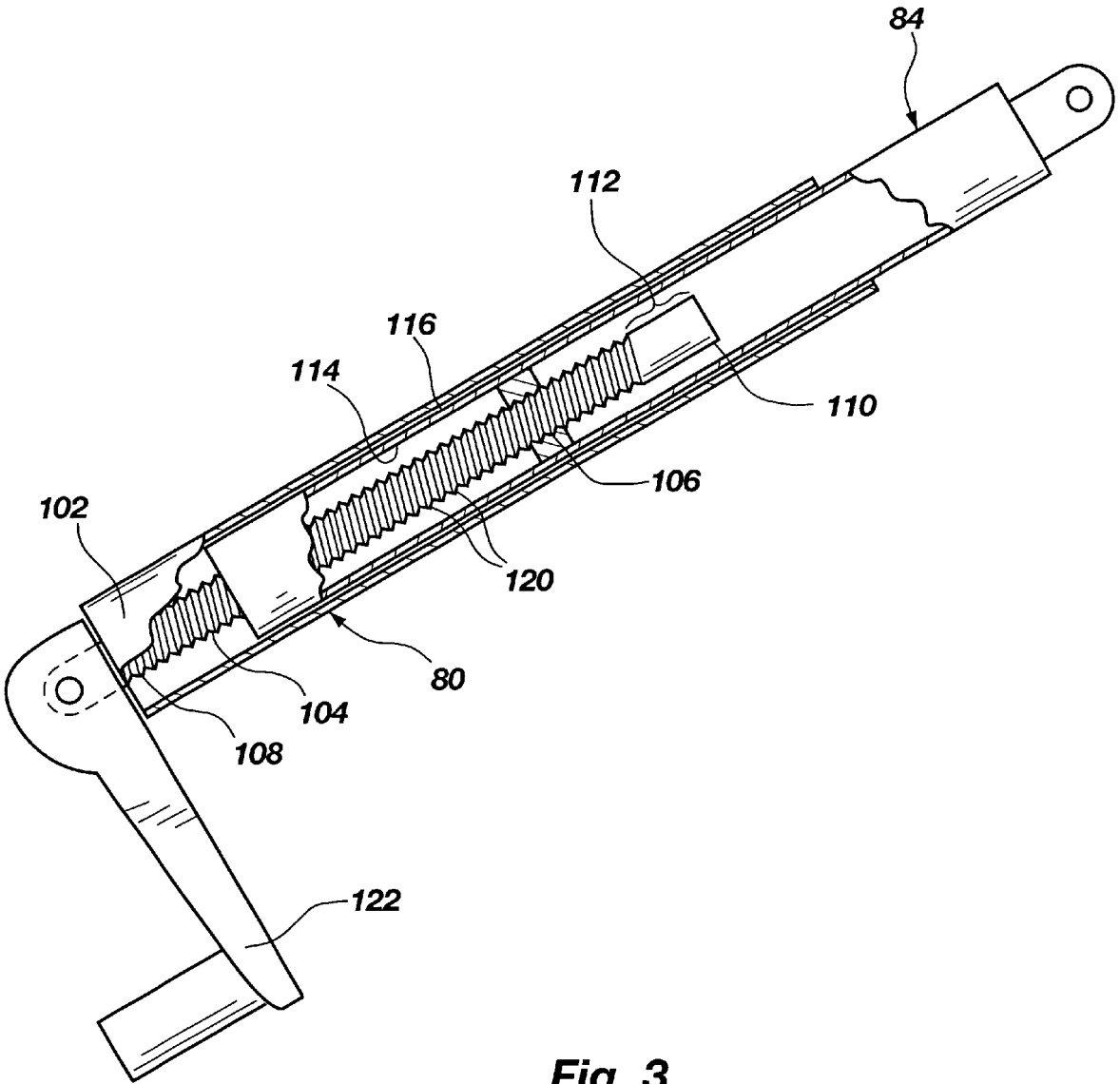
FIG. 3 is a partial cut-away, side cross-sectional view of the compression crank adjustment mechanism of the basketball goal assembly of FIG. 1.

Referring now to FIG. 3, the first adjustment member 80 includes an outer shell 102 and a threaded portion 104 configured for rotatable engagement with a threaded portion 106 of the second adjustment member 84. In one presently preferred embodiment, the first adjustment member 80 comprises a substantially threaded rod 104 positioned within the substantially hollow outer shell 102. The rod 104 is rotatably attached to the outer shell at a first end 108 of the rod 104. A second end 110 of the rod 104 includes a portion 112 that is not threaded. In one presently preferred embodiment, the outer shell 102 of the first adjustment member 80 is substantially cylindrical in shape. Although the adjustment member 80 is illustrated and described in connection with a generally cylindrical configuration, those skilled in the art will recognize that various other geometrical configurations are likewise suitable. The use of a generally cylindrical configuration is thus by way of illustration only and not by way of limitation.

The second adjustment member 84 is substantially hollow having an inner surface 114 and outer surface 116. Preferably, the outer surface 116 is configured to fit within and closely engage the outer shell 102 of the first adjustment member 80 in telescopic engagement. The threaded portion 106 of the second adjustment member 84 comprises a threaded engagement member 106 (e.g., a nut or the like) affixed to the inner surface 114 for threaded engagement with the threaded rod 104. Thus, rotation of the rod 104 relative to the engaging member 106 causes the first adjustment member 80 to move telescopically relative to the second adjustment member 84. When the engaging member 106 is positioned about the unthreaded portion 112, there is no threaded engagement between the first adjustment member 80 and the second adjustment member 84.

As will be appreciated by those skilled in the art, further rotation of the threaded rod 104 at this point will no longer cause the first adjustment member 80 to move relative to the second adjustment member 84. Thus, the engaging member 106 can be positioned to limit adjustment of the height of the basketball goal in one direction. In operation, travel of the engaging member 106 along the threaded rod 104 is limited in the opposite direction when the second adjustment member 84 abuts the first adjustment member 80 at the first end 108 of the rod 106. It will be appreciated by those of skill in the art that the threads 120 on the threaded rod 104 are close enough in distance and comprise a narrow enough pitch to provide the maximum mechanical advantage when turning the rod, thereby facilitating easy turning of the adjustment crank 56.

A variety of threaded members in various combinations may be used to practice the teachings of the present invention such as, for example, a worm gear or drive or a combination of various sized gears positioned for engagement with each other or an adjustment member. Alternatively, a gear in combination with a slotted member may be used such that as the gear turns, the slotted member moves relative to the gear. The slotted member may include the extension arm 60 or either of the adjustment members 80, 84.

As best shown in FIGS. 2 and 3, the adjustment crank 56 also includes a crank handle 122 mechanically attached to the first adjustment member 80 to thereby facilitate selective movement of the first adjustment member 80 relative to the second adjustment member 84. In one presently preferred embodiment, the crank handle 122 is pivotally attached to the rod 104 of the first adjustment member 80 with a cotter pin. As will be appreciated by those skilled in the art, the handle 122 may be attached to the first adjustment member 80 in any number of ways known in the art. For example, one such way may include making the handle 122 an integral part of the rod 104.

With reference back to FIGS. 1 and 2, the height of the basketball goal 20 may be adjusted by engaging the crank handle 122 and rotating it in one direction such that the first and second adjustment members 80, 84 compress relative to each other thereby raising the extension arm 60 and lowering the basketball goal 20 in relation to the playing surface. Alternatively, rotating the crank handle 122 in an opposite direction raises the basketball goal 20 in relation to the playing surface.

Figure 4:
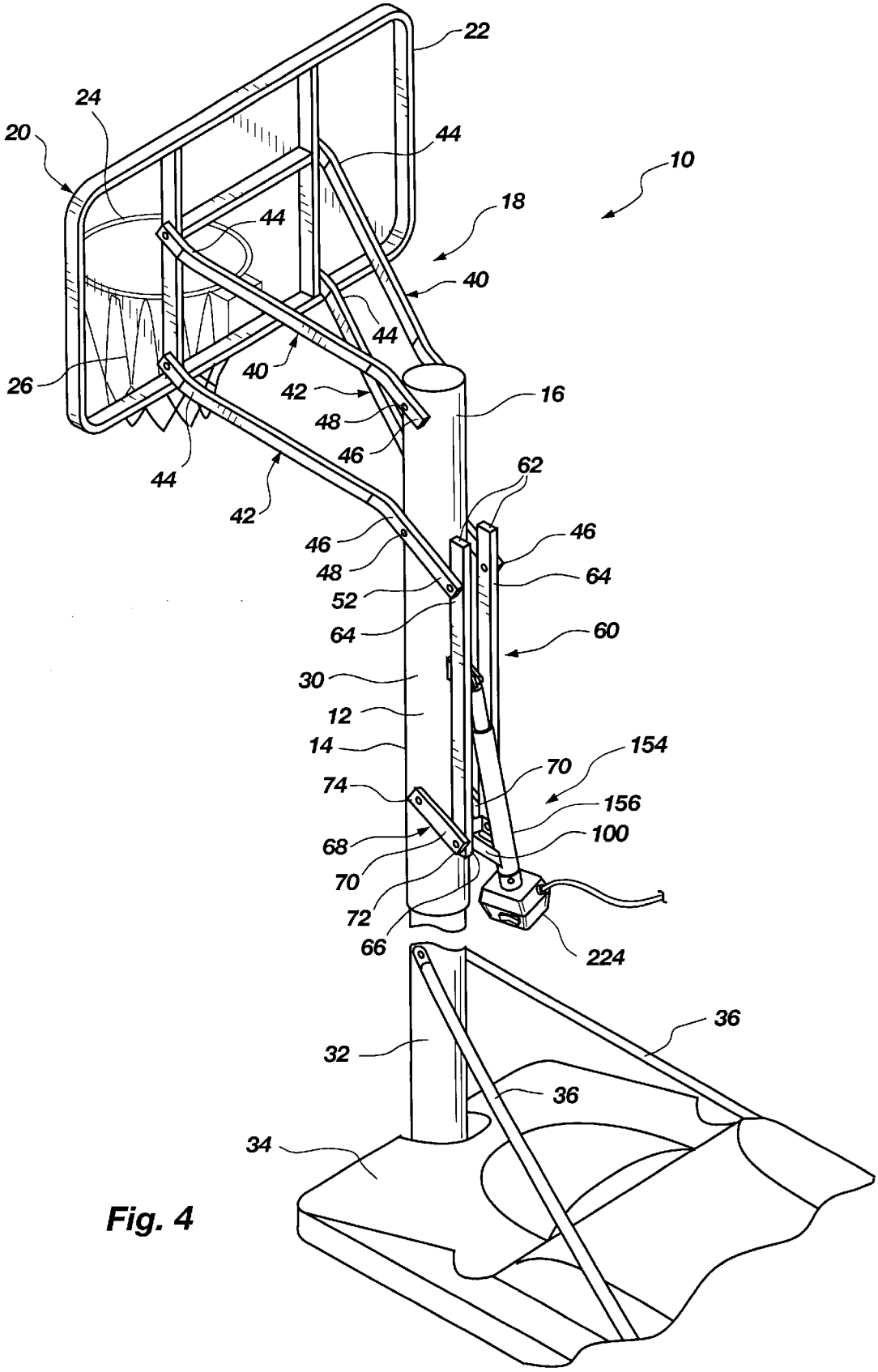
FIG. 4 is a perspective view of yet another presently preferred embodiment of a compression crank adjustment mechanism for a basketball goal assembly of the present invention.
Figure 5:
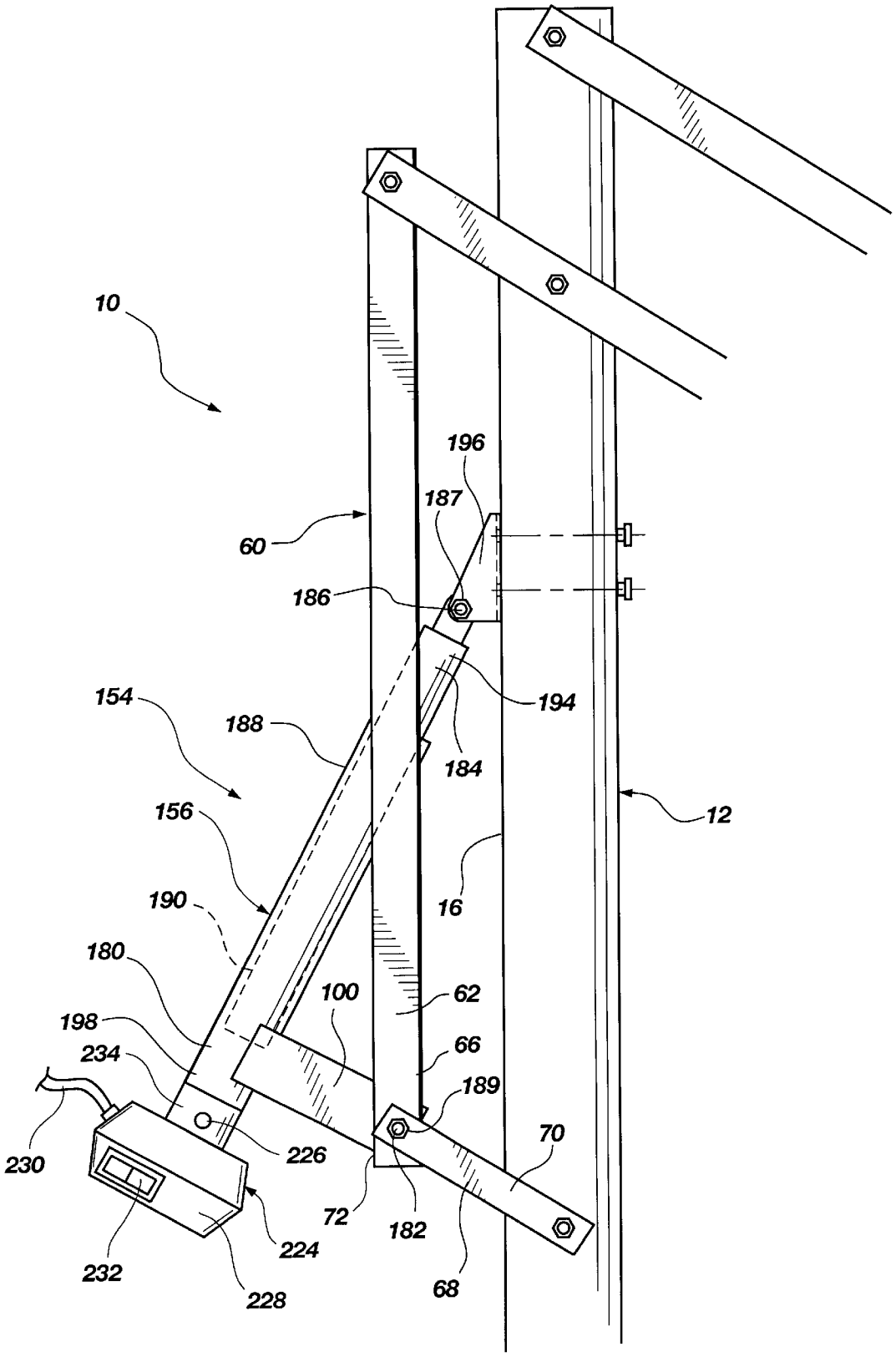
FIG. 5 is a side plan view of the compression crank adjustment mechanism of the basketball goal assembly of FIG. 4.
Figure 6:
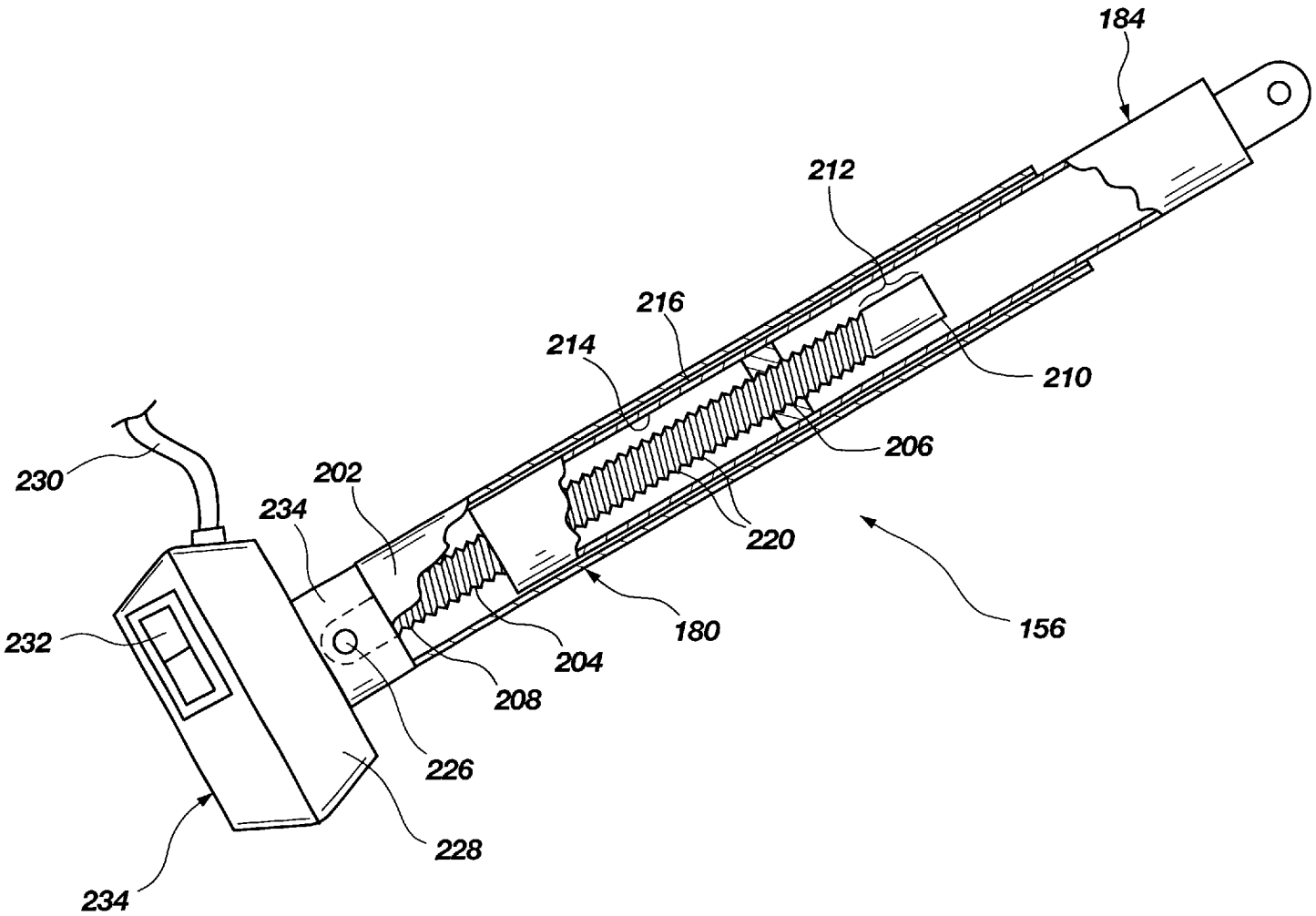
FIG. 6 is a partial cut-away, side cross-sectional view of the compression crank adjustment mechanism of the basketball goal assembly of FIG. 4.

With reference now to FIGS. 4 through 6, another presently preferred embodiment of an adjustment mechanism is generally designated as 154 and includes an adjustment crank 156. Referring to one presently preferred alternate embodiment of the adjustment mechanism 154, as illustrated in FIG. 5, the adjustment crank 156 includes a first adjustment member 180 pivotally connected to the extension arm 60 at a first point of attachment 182. The adjustment crank 156 also includes a second adjustment member 184 pivotally connected to the support pole 12 at a second point of attachment 186. A first end 188 of the first adjustment member 180 is configured to cooperate with a first end 190 of the second adjustment member 184 to facilitate selective movement of the first adjustment member 180 relative to the second adjustment member 184.

A second end 194 of the second adjustment member 184 is preferably connected to the support pole 12 by means of at least one fastener 187 (e.g., bolt, screw, rivet, or the like). As shown, the first adjustment member 180 may include a U-shaped bracket 100 attached (e.g., welded) to a second end 198 thereof. The U-shaped bracket 100 may be configured with a pair of holes (not shown) for receiving a fastener 189 (e.g., bolt, screw, rivet, or the like) through the U-shaped bracket 100 and corresponding holes (not shown) through the second end 66 of each bar 62 of the extension arm 60. In one presently preferred embodiment, the fastener 189 is also positioned within holes (not shown) formed in the first ends 72 of the tie bars 70, such that the adjustment crank 156, the extension arm 60, and the stabilizer arm 68 are all connected at the first point of attachment 182. It will be readily appreciated by those skilled in the art that the adjustment mechanism 154 may be positioned in a variety of ways relative to the extension arm 60 and the support pole 12 to allow the adjustment mechanism 154 to remain in compression, rather than in tension along the back side 16 of the support pole 12.

In one presently preferred embodiment, the adjustment crank 156 is positioned relative to the rigid support 12 and extension arm 60 such that the second point of attachment 186 is disposed above the first point of attachment 182. One of skill in the art will appreciate that in this configuration, the force due to gravity acting on the basketball goal 20 and transferred to the extension arm 60 will cause the first adjustment member 180 and the second adjustment member 184 to be in compression relative to each other. With the first adjustment member 180 and the second adjustment member 184 in compressive engagement relative to each other, failure of the adjustment mechanism 154 will not result in the first adjustment member 180 and the second adjustment member 184 becoming disengaged from each other, which may result in the basketball goal 20 pivoting downward into the playing area. Accordingly, the compressive engagement of the first adjustment member 180 and the second adjustment member 184 along the back side of the support pole 12 provides a measure of security to the adjustable basketball goal assembly 10.

Referring now to FIG. 6, the first adjustment member 180 includes an outer shell 202 and a threaded portion 204 configured for rotatable engagement with a threaded portion 206 of the second adjustment member 184. In one presently preferred embodiment, the first adjustment member 180 comprises a substantially threaded rod 204 positioned within the substantially hollow outer shell 202. Preferably, the rod 204 is rotatably attached to the outer shell at a first end 208 of the rod 204. A second end 210 of the rod 204 may include a leading portion 212 that is not threaded.

The second adjustment member 184 is substantially hollow having an inner surface 214 and outer surface 216. Preferably, the outer surface 216 is configured to fit within and closely engage the outer shell 202 of the first adjustment member 180 in telescopic engagement. The threaded portion 206 of the second adjustment member 184 includes a threaded engagement member 206 such as a fastener (e.g., a nut or the like) affixed to the inner surface 214 for threaded engagement with the threaded rod 204.

As briefly described above, the first adjustment member 180 and the second adjustment member 184 of the adjustment crank 156 incorporate substantially the same corresponding structural elements of the embodiment described in detail above and illustrated in FIGS. 1 through 3. These correspondingly similar structural and functional features therefore will not be discussed in further detail below.

As best shown in FIGS. 5 and 6, one presently preferred embodiment of the adjustment crank 156 includes an electromechanical driver 224 mechanically engaging the first adjustment member 180 to facilitate selective movement of the first adjustment member 180 relative to the second adjustment member 184. The electromechanical driver 224 may be pivotally attached to the rod 204 of the first adjustment member 180 with a cotter pin 226. As will be appreciated by those of skill in the art, other conventional fasteners or fastening means may be used to attach the electromechanical driver 224 to the first adjustment member 180.

In one presently preferred embodiment of the adjustment mechanism 154, the electromechanical driver 224 includes a housing 228 having a 110 volt electric motor (not shown) housed therein, a power source 230 for providing electric power to the electric motor disposed in the housing 228, a switch 232 for selectively providing electric current to the electric motor, and a drive shaft 234 rotatably connected to the electric motor. In functional operation, engagement of the switch 232 causes an electric current to flow to the electric motor, which in turn facilitates rotation of the drive shaft 234 and, correspondingly, selective movement of the first adjustment member 180 relative to the second adjustment member 184. It will be appreciated by those of skill in the art that the power source 230 may include a battery source or an electric current feed from an electric outlet.

The electric motor housed within the housing member 228 of the electromechanical driver 224 is preferably configured to selectively rotate the drive shaft 234 in either a clockwise direction or a counterclockwise direction. Although the electromechanical driver 224 of one presently preferred embodiment is illustrated and described as including a housing 228 having disposed therein an electric motor rotatably connected to a drive shaft 234, those skilled in the art will readily recognize that various other combinations and configurations of electromechanical devices and/or components are likewise suitable for causing rotation of the first adjustment member 180 in relation to the second adjustment member 184, thereby facilitating an adjustment in the height of the basketball goal 20 above a playing surface. The use of an electric motor disposed in a housing 228 and rotatably connected to a drive shaft 234 is thus by way of illustration only and not by way of limitation.

With reference to FIGS. 4 and 5, the height of the basketball goal 20 may be adjusted by the rotation of the drive shaft 234 by means of the electromechanical driver 224 in one direction such that the first and second adjustment members 180, 184 compress relative to each other thereby raising the extension arm 60 and thereby lowering the height of the basketball goal 20 in relation to the playing surface. Alternatively, the rotation of the drive shaft 234 by means of the electromechanical driver 224 in an opposite direction raises the height of the basketball goal 20 in relation to the playing surface.

The invention may be embodied in other specific forms without departing from its spirit or essential characteristics. The described embodiments are to be considered in all respects only as illustrative and not restrictive. Any explanations provided herein of the scientific principles employed in the present invention are illustrative only. The scope of the invention is, therefore, indicated in the appended claims rather than by the foregoing description. All changes within the meaning and range of the claims are to be embraced within their scope.

What is claimed and desired to be secured by United States Letters Patent is:

1. A basketball goal assembly allowing for adjustment of the height of a basketball goal above a playing surface, said basketball goal assembly comprising:

a rigid support pole;

a goal support structure disposed in relation to said support pole, said goal support structure being deformable into a plurality of configurations wherein at each configuration said basketball goal is disposed at a different height above said playing surface;

an extension arm having a first end connected to said goal support structure and a second end connected to said support pole such that movement of said extension arm selectively deforms the goal support structure;

an adjustable compression mechanism comprising a first adjustment member connected to said extension arm and a second adjustment member connected to said support pole, said first adjustment member operably disposed relative to said second adjustment member in a compressive engagement, said first adjustment member having a threaded portion configured for threaded engagement with said second adjustment member; and an electromechanical driver operably engaging said first adjustment member and configured to selectively move the first adjustment member in relation to said second adjustment member to facilitate movement of the first adjustment member relative to the second adjustment member and selectively dispose said goal support structure into said plurality of configurations in relation to said playing surface.

2. A basketball goal assembly as defined in claim 1, wherein said goal support structure is substantially parallelogrammic in configuration.

3. A basketball goal assembly as defined in claim 1, wherein said extension arm is configured to engage a stabilizing arm having a first end pivotally attached to said support pole and a second end pivotally attached to said extension arm.

4. A basketball goal assembly as defined in claim 1, wherein said extension arm is operably disposed contiguous a back side of said support pole.

5. A basketball goal assembly as defined in claim 1, wherein said connection of said first adjustment member of said adjustable compression mechanism is disposed below said connection of said second adjustment member.

6. A basketball goal assembly as defined in claim 1, wherein said electromechanical driver rotates said threaded portion of said first adjustment member relative to said second adjustment member.

7. A basketball goal assembly as defined in claim 1, wherein said electromechanical driver comprises a housing having a motor housed therein.

8. A basketball goal assembly as defined in claim 7, wherein said electromechanical driver comprises a drive shaft connected between said electric motor and said first adjustment member.

9. A basketball goal assembly as defined in claim 7, wherein said electromechanical driver comprises a power source for providing electric power to said motor.

10. A basketball goal assembly as defined in claim 9, wherein said electromechanical driver further comprises a switch for selectively activating said power source to provide electric current to said motor.

11. A basketball goal assembly as defined in claim 1, further comprising a support base having a receiving aperture sufficient for receiving and retaining said support pole in a substantially upright position in relation to said playing surface.

12. A basketball goal assembly as defined in claim 11, wherein said support base comprises an internal cavity sufficient for receiving and selectively retaining a ballast material.

13. A basketball goal assembly allowing for adjustment of the height of a basketball goal above a playing surface, said basketball goal assembly comprising:

a rigid support pole having a goal side and an opposing back side;

a goal support structure disposed in relation to said support pole at said goal side, said goal support structure being deformable into a plurality of configurations wherein at each configuration said basketball goal is disposed at a different height above said playing surface;

an extension arm having a first end connected to said goal support structure and a second end connected to said back side of said support pole such that movement of said extension arm selectively deforms the goal support structure;

an adjustable compression mechanism comprising a first adjustment member connected to said extension arm at a first point of attachment and a second adjustment member connected to said support pole at a second point of attachment, said second point of attachment positionable above said first point of attachment in a compressive engagement, said first adjustment member having a threaded portion configured for threaded engagement with said second adjustment member;

an electromechanical driver operably engaging said first adjustment member and configured to selectively rotate the first adjustment member in relation to said second adjustment member and thereby facilitate movement of the first adjustment member relative to the second adjustment member to selectively dispose said goal support structure into said plurality of configurations in relation to said playing surface.

14. A basketball goal assembly as defined in claim 13, wherein said goal support structure is substantially parallelogrammic in configuration.

15. A basketball goal assembly as defined in claim 13, wherein said extension arm is configured to engage a stabilizing arm having a first end pivotally attached to said support pole and a second end pivotally attached to said extension arm.

16. A basketball goal assembly as defined in claim 13, wherein said extension arm is operably disposed contiguous a back side of said support pole.

17. A basketball goal assembly as defined in claim 13, wherein said electromechanical driver comprises a housing having a motor housed therein.

18. A basketball goal assembly as defined in claim 17, wherein said electromechanical driver comprises a drive shaft connected between said electric motor and said first adjustment member.

19. A basketball goal assembly as defined in claim 17, wherein said electromechanical driver comprises a power source for providing electric power to said motor.

20. A basketball goal assembly as defined in claim 19, wherein said electromechanical driver further comprises a switch for selectively activating said power source to provide electric current to said motor.

21. A basketball goal assembly as defined in claim 13, further comprising a support base having a receiving aperture sufficient for receiving and retaining said support pole in a substantially upright position in relation to said playing surface.

22. A basketball goal assembly as defined in claim 21, wherein said support base comprises an internal cavity sufficient for receiving and selectively retaining a ballast material.

* * * * *